United States Patent [19]

Rodenberger

[11] Patent Number: 4,749,043

[45] Date of Patent: Jun. 7, 1988

[54] SUBSURFACE SAFETY VALVES AND SEALS

[75] Inventor: C. Mark Rodenberger, Prosper, Tex.

[73] Assignee: Otis Engineering Corp., Dallas, Tex.

[21] Appl. No.: 878,306

[22] Filed: Jun. 25, 1986

[51] Int. Cl.[4] ..... E21B 34/10

[52] U.S. Cl. ..... 166/321; 166/322; 277/58; 277/62; 277/236

[58] Field of Search ..... 166/319, 321, 322, 323; 277/236, 117–122, 58, 123; 92/243, 244, 246, 192, 175

[56] References Cited

U.S. PATENT DOCUMENTS

| | | | |
|---|---|---|---|
| 1,166,686 | 1/1916 | Holmes | 277/62 |
| 2,315,012 | 3/1943 | Park | 92/175 |
| 2,720,220 | 10/1955 | Gratzmuller | 92/244 |
| 3,477,731 | 11/1969 | Workman | 277/58 |
| 3,865,141 | 2/1975 | Young | 166/222 X |
| 4,127,168 | 11/1978 | Hanson et al. | 277/236 X |
| 4,324,407 | 4/1982 | Upham et al. | 277/236 X |
| 4,451,047 | 5/1984 | Herd et al. | 277/123 X |
| 4,569,398 | 2/1986 | Pringle | 166/321 |

FOREIGN PATENT DOCUMENTS

| | | | |
|---|---|---|---|
| 1110480 | 7/1961 | Fed. Rep. of Germany | 277/58 |
| 3428007 | 2/1986 | Fed. Rep. of Germany | 277/58 |
| 777177 | 11/1934 | France | 277/236 |

*Primary Examiner*—James A. Leppink
*Assistant Examiner*—Hoang C. Dang
*Attorney, Agent, or Firm*—H. Mathews Garland

[57] ABSTRACT

Subsurface safety valves of the tubing and wireline retrieveable types operated by a control fluid responsive annular piston in an annular cylinder sealed at opposite ends by a two-way static and dynamic metal-to-metal seal assembly which includes central Bellville loading washers, a spacer ring on each side of the loading washers, and a Bellville sealing washer at each end of the spacer rings. The metal-to-metal seals are useful in a number of applications requiring the sealing of pressurized spaces between spaced concentric parts.

11 Claims, 7 Drawing Sheets

SUBSURFACE SAFETY VALVES AND SEALS

BACKGROUND OF THE INVENTION

1. Field of the Invention

This invention relates to surface controlled subsurface safety valves and seals.

2. History of the Prior Art

It is well known to complete oil and gas producing wells with flow control systems which include subsurface safety valves controllable from the surface to shut off fluid flow in the tubing string of a well. Generally, such valves are controlled in response to a control fluid pressure conducted to the valve from a location at the surface end of the well so that the well may be selectively shut in responsive to predetermined conditions which may include rupture of a flow line, fire, and the like. The safety valves may be of either the wireline or tubing retrievable type. The wireline type subsurface safety valve is inserted into and removed from a landing nipple in the tubing string of a well by use of standard wireline equipment and techniques. The tubing retrievable type subsurface safety valve includes a housing which is connected into and becomes an integral part of the well tubing string so that the valve is installed and removed with the tubing string. Both types of subsurface safety valves include a pressure responsive operator piston which often must function under adverse conditions such as the presence of hydrogen sulfide and high temperatures and pressures. Elastomers often used in downhole seal applications frequently will not operate satisfactorily under such well conditions. A further factor affecting the integrity of seals used in subsurface safety valves is that the seals must be effective under both static and dynamic conditions. The operating pistons in the safety valves must move to open and close the valves so that a seal must be achieved between adjacent surfaces, one moving relative to the other.

Metal-to-metal seals have been used in downhole applications to overcome environmental problems such as corrosive fluids and high temeratures and pressures. For example, in U.S. Pat. No. 4,429,620, a metal-to-metal seal is shown to seal under static conditions. While the patented seal is supported around a moving piston, a seal is effective only at the end of each stroke of the piston responsive to mechanical compressive forces which expand the seal into contact with an adjacent surface. Thus, the seal is not designed to function in response to fluid pressure and under dynamic conditions when the piston is moving relative to the cylinder wall. Similarly, U.S. Pat. No. 4,346,919 shows a metal-to-metal static seal. U.S. Pat. No. 4,452,310 shows a dynamic metal-to-metal seal which is not, however, structurally adaptable to seal the annular space around the operator piston of a subsurface safety valve as in applicant's device. Additionally, the seal assembly of U.S. Pat. No. 4,452,310 is more complex and more expensive to manufacture and install than the seal disclosed by applicant.

SUMMARY OF THE INVENTION

In accordance with the present invention there is provided a subsurface safety valve, a wireline retrievable valve or a tubing retrievable valve, and a high temperature, high pressure metal-to-metal seal useful therewith. The subsurface safety valve includes a housing having a longitudinal bore therethrough, a valve in the housing for movement between open and closed positions for controlling flow through the bore, an operator tube within the housing having a bore therethrough coupled with the valve for opening and closing the valve, means for biasing the operator tube in a direction to close the valve, and annular piston on the operator tube within an annular cylinder between the operator tube and the housing functioning responsive to fluid pressure in the annular cylinder for moving the piston in a direction to open the valve and holding the valve open, and static and dynamic metal-to-metal seal means, in accordance with the invention, between the piston and the cylinder wall to effect a fluid tight seal between the piston and the cylinder wall. The seal means provides a two-way seal, first containing the control fluid pressure in the annular cylinder, and second protecting the control line from well pressure when the subsurface safety valve is closed. Further, in accordance with the invention the metal-to-metal seal comprises central loading Bellville washers, spacer rings on opposite sides of the loading washers, and a sealing Bellville washer at each of the opposite ends of the spacer rings for two-way protection. Each of the sealing Bellville washers has a parallelogram cross section shape with the long diagonal being the sealing diagonal and a relieved or broken edge at the long diagonal corner facing against the direction of movement of the moveable member with which the washer seals to minimize jamming with the moveable member. The metal-to-metal seal of the invention is useful not only with subsurface safety valves of the wireline and tubing retrievable type but also in other high temperature and pressure applications between relatively moveable parts.

It is a principal object of the invention to provide a new and improved wireline retrievable subsurface safety valve having a two-way static and dynamic metal-to-metal seal between the valve housing and the operator piston.

It is another principal object of the invention to provide a new and improved tubing retrievable type subsurface safety valve using a metal-to-metal seal between the operator piston and the valve housing.

It is another object of the invention to provide a metal-to-metal seal between relatively moveable parts under conditions of high temperature and corrosion.

It is another object of the invention to provide a twoway static and dynamic metal-to-metal seal for sealing an annular space between concentric parts and comprising central loading Bellville washers, spacer rings on opposite sides of the loading washers, and a sealing Bellville washer at the opposite end of each of the spacer rings.

It is another object of the invention to provide a metal-to-metal seal operable between moving parts.

It is another object of the invention to provide a metal-to-metal seal which is effective under a wide range range of temperature and pressure conditions.

It is another object of the invention to provide a metal-to-metal seal which is preloaded to provide static sealing under lower pressure conditions and is affected by increasing pressures to increase the sealing effect proportional to the pressure applied across the seal for dynamic sealing.

The above and other objects and features of the invention will be apparent to those skilled in the art from the following detailed description of the present invention taken in conjunction with the accompaning drawings in which preferred embodiments of the device of the invention are shown.

DESCRIPTION OF THE PREFERRED EMBODIMENT

Figure 1:
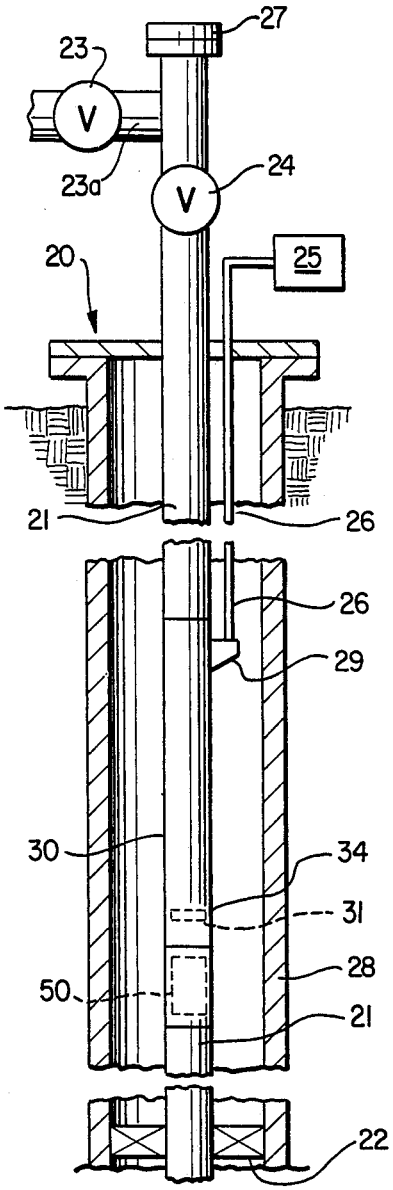
FIG. 1 is schematic view in section and elevation of a typical well completion system including a subsurface safety valve emboding the features of the invention.

Referring to FIG. 1, a well completion system 20 includes a casing string 28 extending from the surface to a producing formation from which hydrocarbon fluids flow into the well. A producing tubing string 21 extends from the wellhead in the casing string through a production packer 22 which seals between tubing string and the casing directing the formation fluids such as oil, gas, water, and the like into the tubing string from perforations (not shown) in the casing which admit the fluids from the formation into the well bore. Flow control valves 23 and 24 in the tubing string and in a lateral flow line 23*a* control fluid flow at the wellhead from the tubing string. A wellhead cap 27 is secured on the upper end of the tubing string to permit the string to be opened for servicing the well using wireline techniques and apparatus which may include the installation and removal of various flow control devices within the tubing string.

The well system 20 includes a surface controlled subsurface safety valve 30 of the type illustrated in FIGS. 2 and 3, which embodies the features of the invention and is installed in the well as a part of the tubing string 21 to control fluid flow to the surface in the tubing string from a downhole location. The safety valve 30 is operated from the surface by control fluid conducted from a hydraulic manifold 25 at the surface to a side fitting 29 which directs the fluids into the tubing string to the safety valve. The hydraulic manifold 25 may include pumps, a fluid reservoir, accumulators, and control valves for the purpose for providing controlled pressure fluid to the safety valve for holding the safety valve open, allowing the valve to close when desired, and reopening the safely valve. The manifold 25 may also include apparatus which functions in response to temperature, surface line leaks, and the like, evidencing emergency conditions under which the well should be shut in. The safety valve 30 includes a flapper-type valve member 31 mounted on a hinge 34 for swinging between a closed position schematically represented in FIG. 1 and an open position at full flow permitting upward flow in the tubing string 21. When a predetermined pressure is applied to the safety valve through the line 26 from the surface, the flapper member 31 is maintained at the open position. When the pressure is released the valve is allowed to close. A lock-out sleeve 50 is provided in the valve for movement between the first position at which the valve member is free to open and close, and a second position at which the lockout sleeve holds the valve member open. In accordance with the invention, the valve 30 includes two-way metal-to-metal seals for sealing with the operator piston of the valve at opposite ends of an annular control cylinder in which the control fluid functions for operating the valve between open and closed positions. While the valve 30 schematically illustrated in FIG. 1 is the tubing retrievable valve of FIGS. 2 and 3, a wireline retrievable valve as illustrated in FIGS. 4 and 5, may be used. When the wireline type valve used, a suitable conventional landing nipple, not shown, is substituted in the tubing string for the housing of the valve 30 as illustrated, and the wireline retrievable valve shown in FIGS. 4 and 5 is landed and locked in the landing nipple. Landing nipples connectable with a well tubing string and provided with fittings for control fluid operation of the safety valve in the nipple are well known.

Figure 3A:
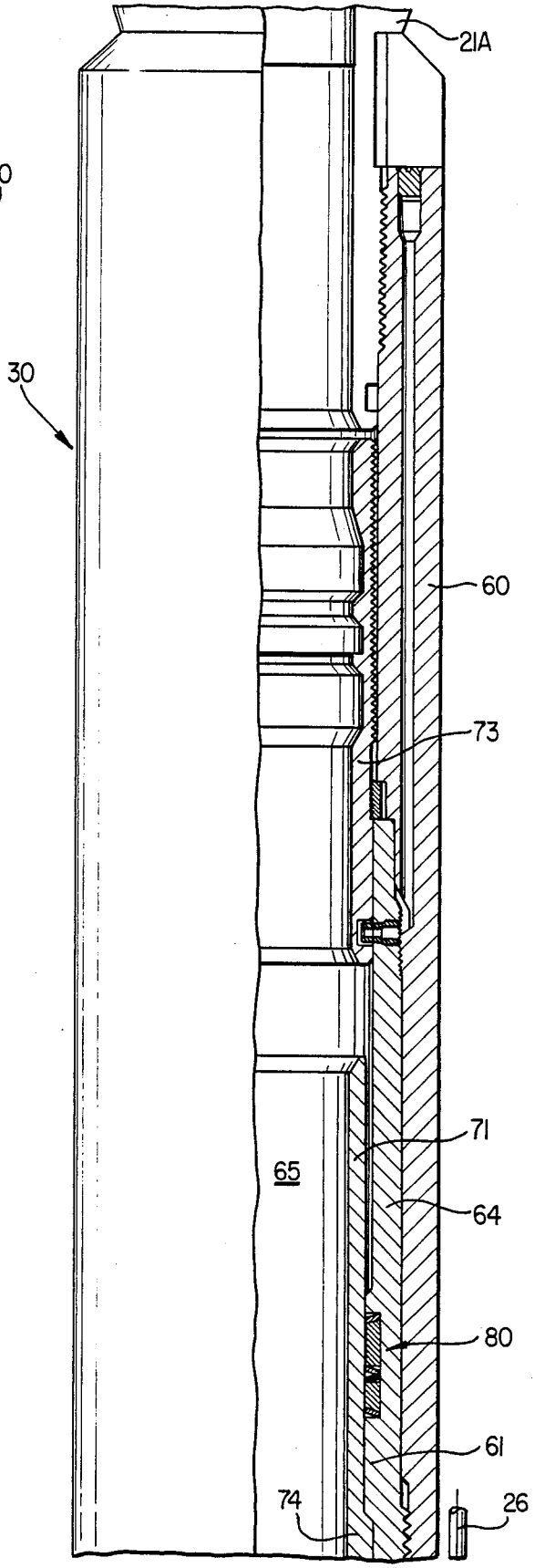
FIGS. 3A, 3B, and 3C taken together form a longitudinal view in section and elevation of the valve of FIG. 2 showing the valve closed.
Figure 3B:
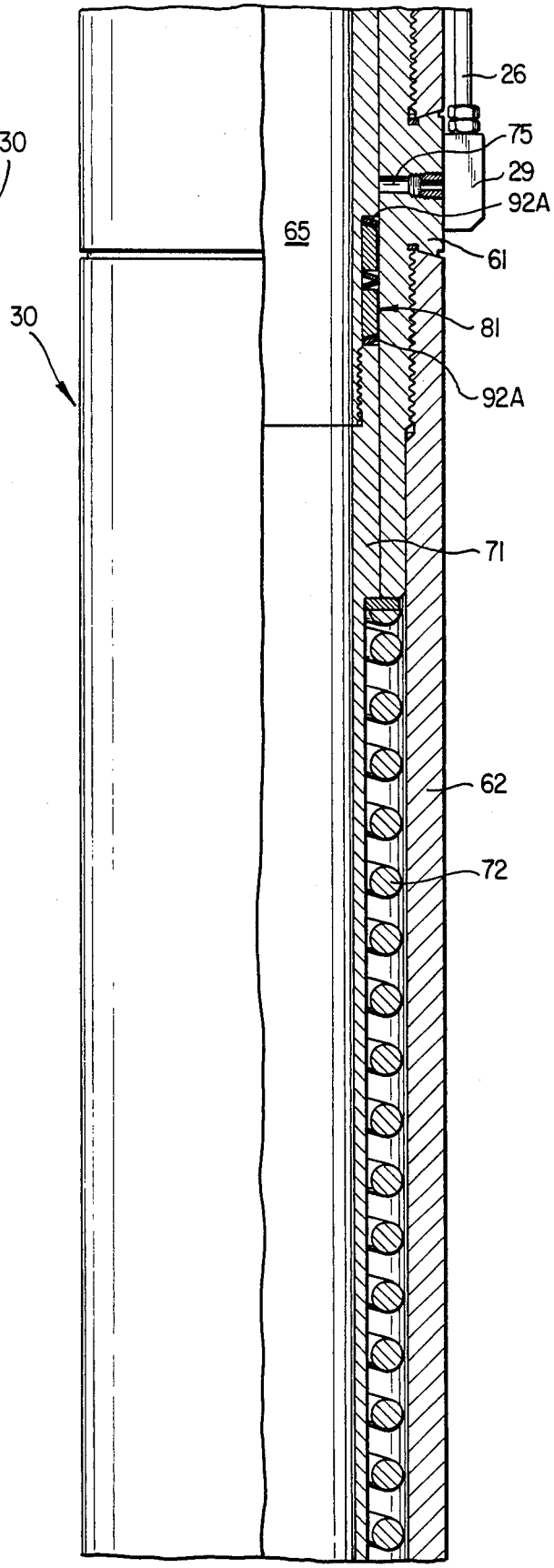
Figure 3C:
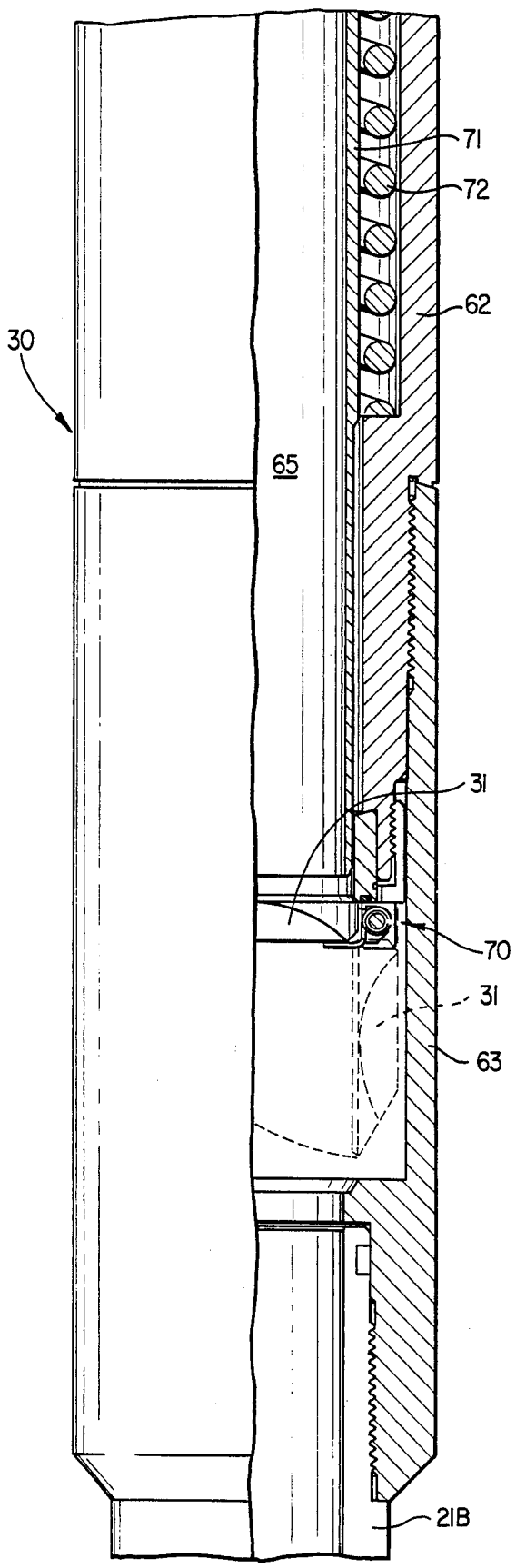

Referring to FIGS. 3A, 3B, and 3C, the wireline retrievable form of valve 30 has a housing formed of tubular sections 60, 61, 62, and 63 which are tubular members threaded together in tandem and connected with upper tubing string section 21A and lower tubing string section 21B, whereby the subsurface valve housing becomes an integral part of the tubing string 21 and is run and retrieved with the string. A tubular insert 64 is disposed in the housing section 60 aligned in tandem with the upper end of the housing section 61, FIG. 3A. The housing has a central bore defining a flow passage 65 communicating at opposite ends of the housing with the upper and lower well tubing sections 21A and 21B. A flow control valve assembly 70 including the valve member 31 is mounted in the housing to control flow along the tubing string through the flow passage 65. The valve assembly 70 is a conventional flapper type valve opened and closed responsive to longitudinal movement of an operator tube 71 which is moved downwardly for opening the valve by control fluid pressure communicated from the surface end of the well. The valve is closed upwardly by a spring 72. The operator tube may be latched downwardly at a valve open position by an internal lock-out sleeve 73, FIG. 3A. The structural features and the operation of the valve 30 including the flapper valve assembly 70, the operator tube 71, the spring 72, and the control fluid system for operating the valve from the surface through the control fluid line 26 and the fitting 29 is substantially identical to an Otis Series 10 surface controlled tubing-retrievable safety valve as illustrated and described at page 164 of the General Sales Catalog of Otis Engineering Corporation, Dallas, Tx., OEC 5338, published in March 1985.

The flapper valve assembly 70 is opened and held opened in the subsurface safety valve 30 by an annular hydraulic piston 74 forming a section of the operator tube 71. The piston 74 moves longitudinally within the valve housing section 61 functioning in response to control fluid pressure from the surface through the control fluid line 26 and the side fitting 29 which opens through a side port 75 into the housing section 61 around the annular piston 74. The annular space between the annular piston 74 and the housing section 61 defines an annular control fluid cylinder which, in accordance with the invention, is sealed at upper and lower ends, respectively, by a two-way upper metal-to-metal seal assembly 80 and a two-way lower metal-to-metal seal assembly 81. The upper seal assembly 80 seals with the outer surface of the operator tube 71 above the piston 74. The lower seal assembly 81 is carried by the annular piston 74 sealing with the inner surface of the housing section 61. The annular area defined between the lines of sealing of the upper seal assembly 80 and the lower seal assembly 81 is an upwardly facing area over which control fluid pressure acts on the piston to move the operator tube 71 downwardly for opening and holding the valve assembly 70 open.

Figure 6:
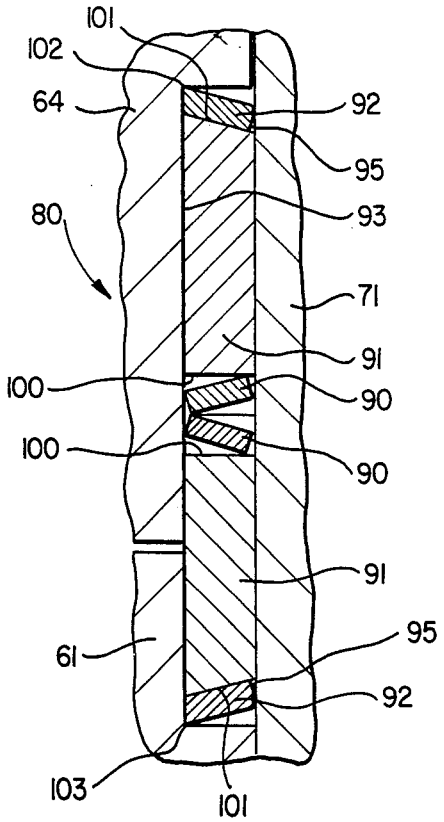
FIG. 6 is an enlarged fragmentary view in section of the metal-to-metal seal of the invention showing specifically the upper seal of the subsurface safety valve shown in FIG. 4A, illustrating the arrangement of seal in the fixed housing of the safety valve to seal with the movable operator tube of the valve.
Figure 7:
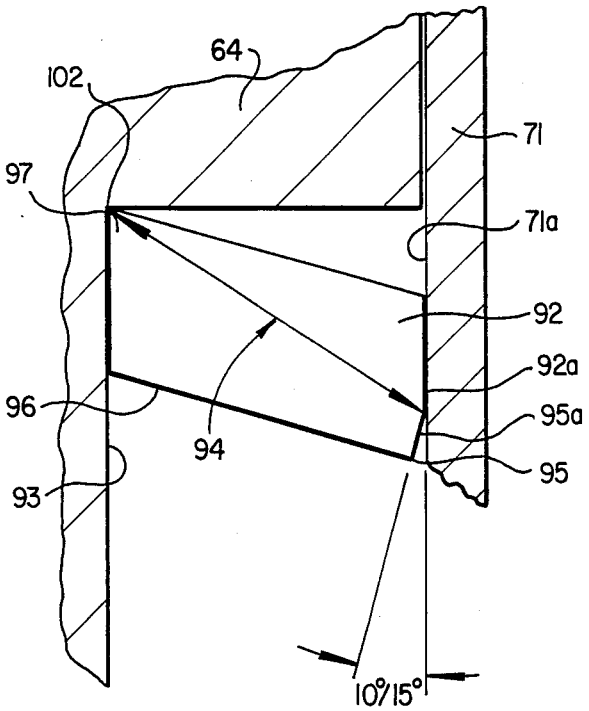
FIG. 7 is a still further enlarged view in section of the upper end sealing Bellville washer of the seal assembly as shown in FIG. 6 illustrating particularly the relieved corner sealing edge to minimize jamming of the washer with the moveable operator tube of the valve.
Figure 2A:
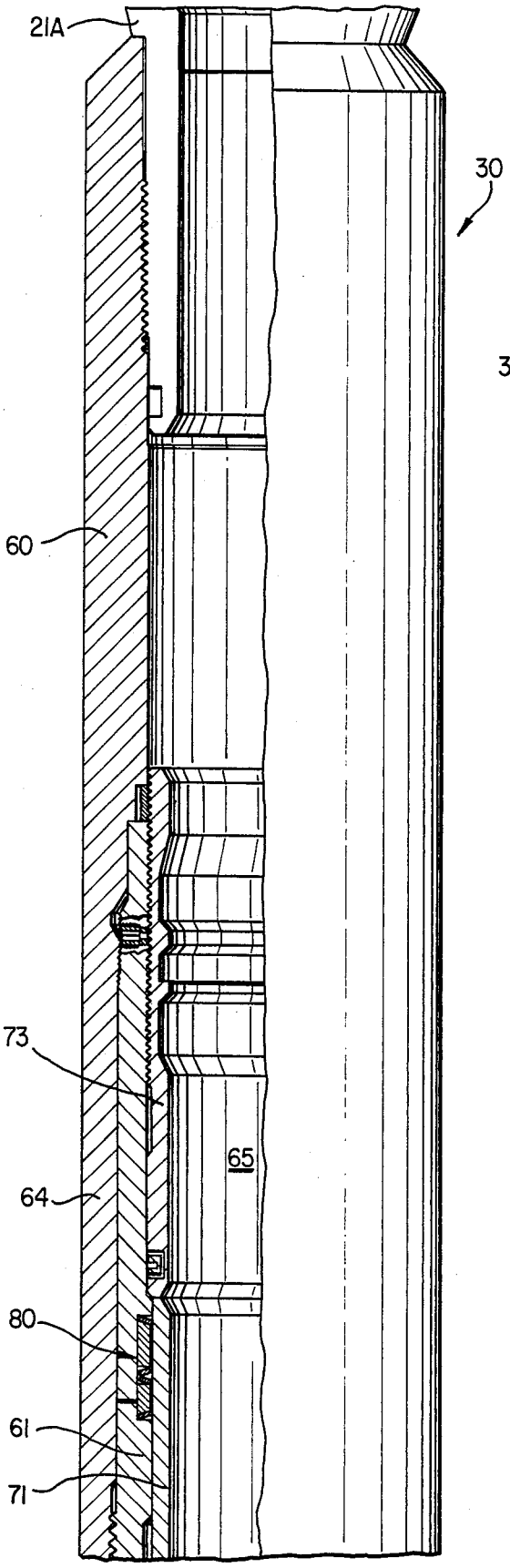
FIGS. 2A, 2B, and 2C form a longitudinal view in section and elevation of a tubing retrievable subsurface safety valve including a metal-to-metal seal in accordance with the invention, showing the valve in open position.
Figure 4A:
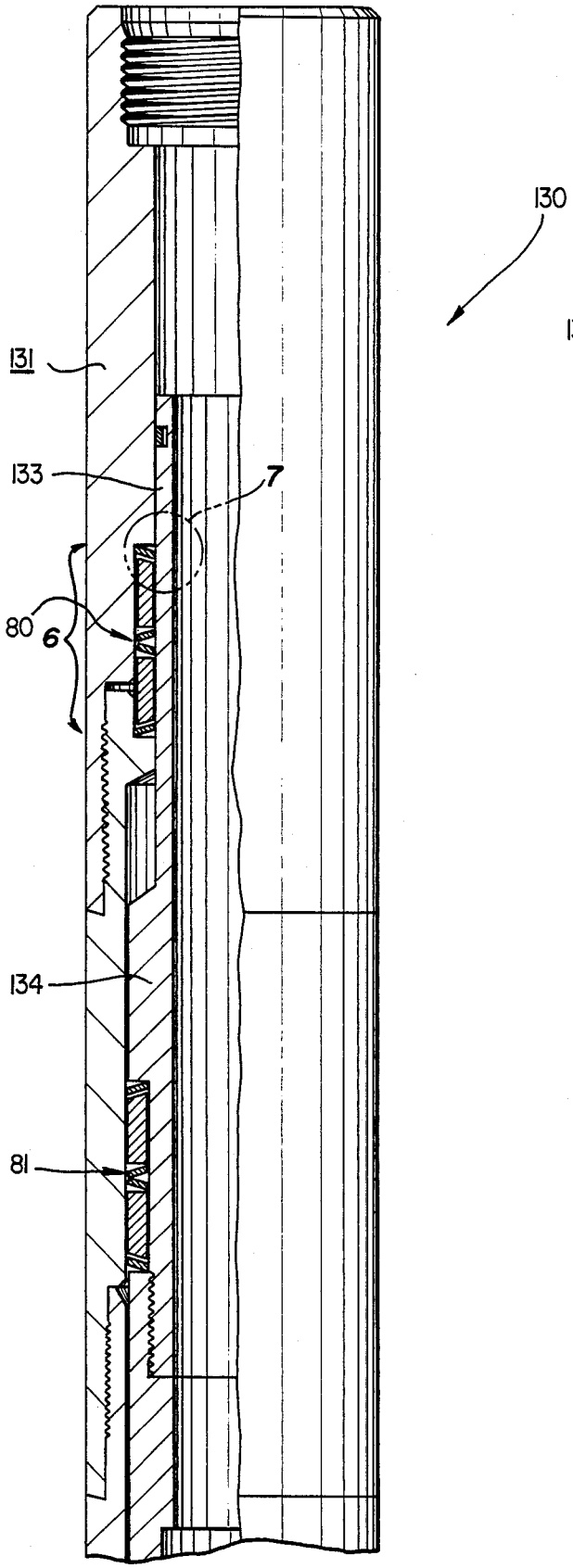
FIGS. 4A, 4B, and 4C together form a longitudinal view in section and elevation of a wireline retrievable subsurface safety valve including a metal-to-metal seal in accordance with the invention, showing the valve open.
Figure 4B:
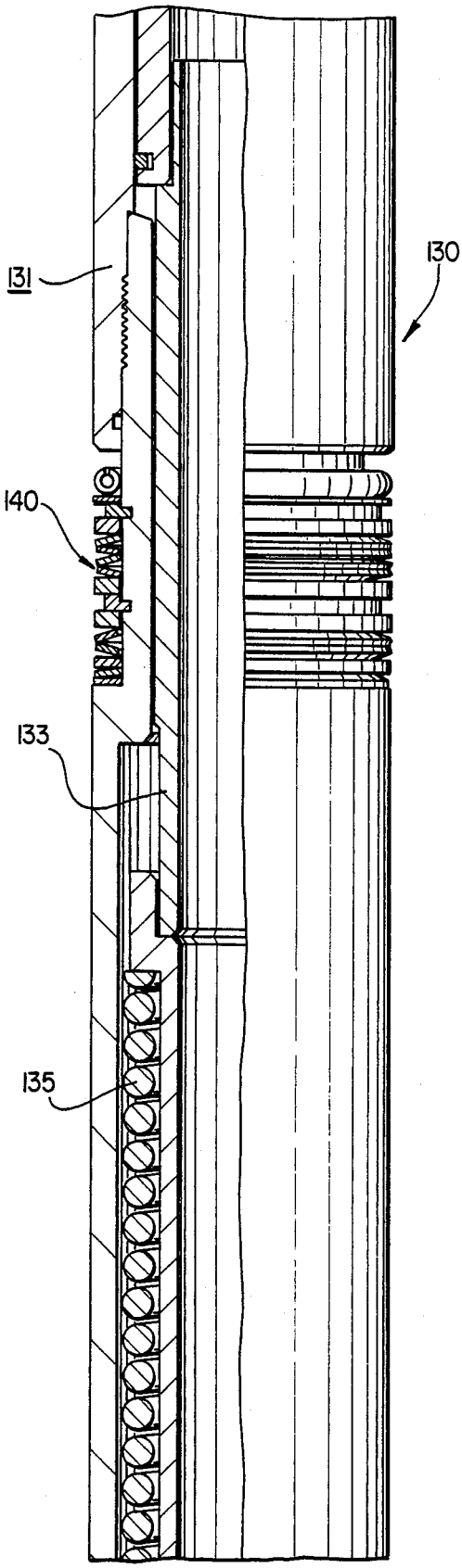
Figure 4C:
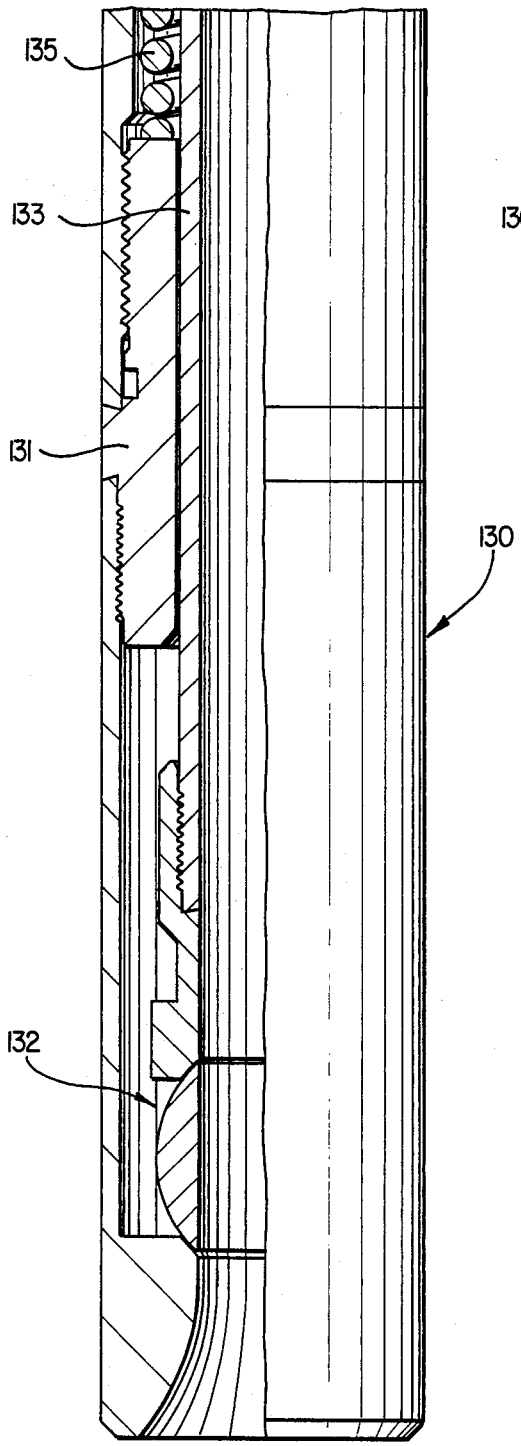

Referring to FIGS. 2A and 6, in accordance with the invention, the upper metal-to-metal seal assembly 80 comprises a pair of central, identical, loading Bellville washers 90, a pair of identical spacer rings 91, and a pair identical upper and lower end sealing Bellville washers 92. The view of the seal assembly 80 shown in FIG. 6 is an enlargement of the same view of the seal assembly as shown in FIGS. 2A and 4A. The seal assembly 80 is confined within an internal annular housing recess 93 defined within the lower end portion of the housing section insert 64 and the upper end portion of the housing section 61 which is telescoped into the lower end of the housing section 60. Each of the Bellville washers 90 and 92 is a frusto-conical annular metal ring. The loading washers 90 are rectangular in cross section and arranged stacked in opposite directions between the spacer rings 91. As best shown in FIG. 7, the sealing washers 92 each has a parallelogram cross section. Each of the sealing washers 92 seals around the annular corner edges, both inner and outer, at the opposite ends of the long diagonal 94, FIG. 7 which shall be referred to as the "sealing diagonal". The particular cross section view shown in FIG. 7 represents the upper sealing washer 92 as shown in FIG. 6. The bore of each of the sealing washers 92 has a chamfered sealing corner edge 95 at the end of the sealing diagonal at which the washer bore surface is engageable with the moveable surface 71*a* with which the washer seals. That sealing corner edge also is the corner at the face of the washer which is aligned at an angle greater than 90 degrees with the surface with which the corner edge seals. The chamfered corner is provided by forming an internal annular conical surface 95*a* in the washer bore aligned at an angle of 10 to 15 degrees sloping outwardly from and relative to the bore surface 92*a* of this washer. Shown in FIG. 7 the face 96 of the washer 92 is positioned at an angle greater than 90 degrees with the outer surface 71*a* of the operator tube 71 with which the corner edge 95 seals. The chamfered corner edge 95 is provided to minimize binding or jamming of the washer 92 with the relatively moveable surface with which the edge is sealing. For example, in FIG.7, if the surface 96 were fully extended to the washer bore at the outer surface of the operator tube 71*a* and the operator tube is moved upwardly the corner edge 95 of the washer 92 would tend to bind or dig into the outer surface 71*a* of the tube 71. By chamfering the corner edge 94, this binding condition does not tend to develop between the sealing corner edge of the washer 92 and the surface 71*a* of the moveable member. Without the chamfer, the intersection of the washer surface 96 and the washer bore 92*a* would be a sharp edge of less than 90 degrees. As stated otherwise, the chamfered corner edge is the sealing corner edge at the face of the sealing Bellville washer which slopes toward the moveable member at an angle in excess of 90 degrees, such as the face 96 which makes a greater than 90 degree angle with the outer surface of the operator tube 71 as shown in FIG. 7. It will be evident from FIG. 7 that if the corner edge 95 of the washer 92 were not chamfered, such corner edge would tend to dig into or jam with the outer face of the operator tube 71 when the relative movement between the washer and the operator tube is such that the operator tube moves upwardly relatively to the washer. Based upon such criteria, of course, the lower sealing washer 92 in FIG. 6 has an upper inside chamfered bore edge 95. The upper and lower sealing washers 92 are identical in the assembly of FIG. 6, arranged so that the bottom and top washers face in opposite directions. Thus, in terms of the slope of the washers 92, the top washer slopes downwardly and inwardly while the bottom washer slopes upwardly and inwardly. Thus, the lower inward bore edge 95 of the top washer is chamfered while the upper inward bore edge of the bottom washer 92 is chamfered. Both of the spacer rings 91 are identical in shape and oriented in opposite directions in the seal assembly 80. Each end face 100 of the spacer rings 91 at the inward ends adjacent to the loading washers 90 is square, or lies in a plane perpendicular to the longitudinal axis of the ring. The outer or opposite ends 101 of the spacer rings 91 are tapered toward the longitudinal axis of the rings in the direction of the center of the seal assembly as defined by the loading washers 90. The outside long diagonal sealing corner 97 of the upper washer 92 engages the upper outside corner 102 of the internal annular recess 93 in which the seal assembly 80 is positioned. The outer long diagonal corner 97 of the lower washer 92 is similarly engaged in the bottom outer corner 103 of the seal assembly recess 93. The distance between the top corner 102 and the bottom corner 103 of the recess 93 is slightly less than the sum of the lengths of all of the parts of the seal assembly 80 in relaxed condition so that when the seal assembly is installed in the recess 93, the center loading washers 90 are compressed sufficiently to apply an axial force to both of the spacer rings 91 urging the rings 91 apart against the top and bottom sealing washers 92. The axial forces applied by the spacer rings 91 to the sealing washers 92 tend to flatten each of the washers increasing the outside diameter and decreasing the inside diameter of each washer. The long diagonal outer sealing corner 97 of the top washer is engaged in the recess corner 102 so that the washer body as seen in section in FIGS. 6 and 7, as it is flattened, tends to rotate counter-clockwise about the outer corner 97 so that the inner long diagonal corner edge 95 of the washer is urged against the outer surface 71*a* of the operator tube 71 effecting an initial static seal between the bottom surface of the recess 93 and the outer surface 71*a* of the operator tube 71. Similarly, the downward force on the lower spacer ring 91 tends to flatten the bottom sealing washer 92 so that as seen in cross section the washer body rotates clockwise along the long diagonal outer sealing corner 97 of the washer urging the inside long diagonal sealing corner 95 against the outer surface 71*a* of the operator tube 71, also effecting an initial static seal between the washer outside edge surface, the bottom surface of the recess 93, and the outside surface of the operator tube 71. Thus, the preoutside loading effect of the loading washers 90 on the end sealing washers 92 establishes an initial seal between the outer surface 71*a* of the operator tube 71 and the inside bottom surface of the recess 93 sealing between the parts 71 and 64 along the annular space between the parts. It well known that the Bellville washers may be readily seated and unseated and permit axial forces to be developed as the compressive forces tending to flatten the washers are increased. Referring to FIG. 7 as the sealing washer 92 is compressed, the outer diameter at the outer sealing corner 97 tends to increase, while the inner diameter at the inner sealing corner 95 tends to decrease, thereby more tightly wedging the washer between the parts 71 and 64 as the degree of flatness of the washers increase. What shall also be referred to as a dynamic seal is effected between the sealed parts by the seal assembly 80. Referring to FIG. 6, fluid pressure between the parts 71 and 64 is produced by control fluid pressure into subsurface safety valve through the line 26 from the surface causes the sealing effect of the seal assembly to increase as the control fluid pressure increases. Since the seal assembly 80 illustrated in FIG. 6 is the upper seal assembly in the subsurface safety valve 30 shown in FIGS. 3A and 2A, control fluid pressure in the safety valve through the line 26 is communicated upwardly between the valve parts 71 and 64 from below the seal 80. The action of the control fluid pressure on the bottom sealing washer 92 is to tend to rotate the washer as viewed in cross section counter-clockwise so that the inside long diagonal sealing corner 95 is urged away from the outer surface 71*a* of the operator tube 71 upwardly past the lower spacer ring 91 and the loading washers 90 which do not serve a sealing function. The pressure is communicated farther upwardly past the upper spacer ring 91 against the top sealing washer 92. Since the outer long diagonal sealing corner 96 of the top washer 92 is engaged in the recess corner 102, increases in pressure from below the washer applies a force to the washer, which was initially sealed by the force of the loading washers 90, so that the top washer, as seen in cross section in FIGS. 6 and 7, tends to pivot counterclockwise about the long diagonal corner 97 so that the inside sealing corner 95 of the bore of the top washer 92 is urged more tightly against the outer surface of the operator tube 71 producing an increase in the sealing effect of the washer proportional to increases in the fluid pressure between the parts 71 and 64 along the seal assembly 80. The seal assembly 80 provides a two-way seal. If the fluid pressure source between the parts 71 and 64 changes so that the pressure is applied from above the seal assembly 80 the reverse effect occurs. Downward pressure along the seal assembly 80 passes the top sealing washer 92, the loading washer 90, and tends to force the bottom washer 92 clockwise as seen in FIG. 6 so that the seal developed between the parts 71 and 64 and the inner and outer sealing corners 95 and 97 of the bottom washer is increased proportional to any increase in the fluid pressure between the parts. When the operator tube 71 moves downwardly relative to the housing members 61 and 64, the angular relationships between the outer surface of the operator tube 71 and the contacting surfaces of the top sealing washer 92 and the center loading washers 90 minimizes interference or binding between the washers and the operator tube surface which might otherwise tend to wedge the washers against the surface to intefere with the downward movement of the operator tube 71. The chamfered edge 94 on the bottom washer 92 similarly minimizes binding between the bottom washer and the surface 71*a* of the operator tube 71 as the tube moves downwardly. Similarly, as the operator tube 71 moves upwardly relative to the seal assembly 80, the bottom washer 92 as well as the loading washers do not tend to bind and the long diagonal inside corner edge chamfered edge 95 of the top washer 92 minimizes any wedging effect between the top washer and the surface of the operator tube 71.

The Bellville washers, particularly the sealing washers 92 of the seal assembly 80, are preferably made of titanium, which, in comparison with steel, has a lower modulus of elasticity thereby providing a washer which is less stiff than steel, is softer, and will flex more easily.

The lower seal assembly 81, FIG. 3B, is identical in structure and function to the seal assembly 80 with one exception. The seal assembly 80 is mounted in the recess 93 of the housing so that the operator tube 71 moves relative to the seal assembly. In contrast the lower seal assembly 81 is mounted in the operator tube 71, defining the lower end of the piston 74 of the operator tube so that the seal assembly 81 moves relative to the fixed housing section 61. Because the seal assembly 81 is moving relative to the housing surrounding the seal assembly, the outer long diagonal sealing corner edges of the top and bottom sealing washer 92A are chamfered to minimize binding against the internal housing surfaces as the outer edges of the sealing washers move along the inside housing surfaces. Specifically the top sealing washer 92A has a chamfered lower outside long diagonal corner edge to minimize binding of such corner edge with the inside surface of the housing as the operator tube moves downwardly in the housing. The bottom sealing washer 92A is identical to the top, simply being reversed in orientation so that the top outside long diagonal corner edge of the washer is chamfered to minimize binding of the washer against the inner surface of the housing as the operator tube with the seal assembly 81 moves upwardly in the housing. The chamfered surface around the outside of the washers 92A is cut at 10–15 degrees relative to the annular outer surface of each washer. Fluid pressure between the operator tube 71 and the housing section 61 above the seal assembly 81 is communicated past the top washer 92A, the loading washers 90, to the bottom washer 92A which is urged in a clockwise direction as seen in section in FIG. 3B to more tightly wedge the washer or spread the washer between the housing and the operator tube for increasing the seal between the members as the fluid pressure increases. If pressure conditions change reversing the direction from which the higher pressure comes so that the pressure above the seal assembly 81 is less than the pressure below, the top sealing washer 92A seals between the housing section and operator tube.

The seals 80 and 81 seal in both directions which is especially important for protecting the control fluid line 26 from well pressure when the subsurface safety valve is closed.

The use of the metal-to-metal seals 80 and 81 produces a particularly effective subsurface safety valve 30 which is operable under extreme conditions of corrosive materials in a well, as well as high operating pressures. The use of the softer metal titanium for the Bellville washers in the seal assembly provides a seal assembly in which wear occurs primarily on the washers rather than in the housing and on the operator tube, so that uneven wear is avoided on such parts of the safety valve.

Referring particularly to FIG. 6 for still further details of the seal assembly 80, the seal assembly as installed in the mounting recess 93 of the valve housing, includes the end sealing washers 92 which slope together toward the longitudinal axis of the seal assembly which, of course, is coincident with the longitudinal axis of the valve operator tube 71. The near corners longitudinally at the inside edges of the sealing washers 92, corners 95, are chamfered to taper outwardly from the longitudinal axis of the seal assembly to minimize the binding between the sealing washers and the operator tube 71, see FIG. 7. The chamfer is preferably 10–15 degrees. The end sealing washers slope together from the back or inside corners of the mounting recess. The same principles of construction apply to the lower seal assembly 80 in which the end sealing washers 92A slope together from the bottom or inside corners of the mounting recess and the longitudinally nearest outside corner edges are chamfered minimize binding of the washer edges with housing bore surface along which the assembly moves. Thus, in the instance of both the upper and lower seal assemblies, the end sealing washers slope toward each other from the inside or back corners of the mounting recess, and the longitudinally nearest corner edges are chamfered. Thus, the outer nearest edges of each of the end seals installed in the mounting recess of the assembly are chamfered.

Figure 2B:
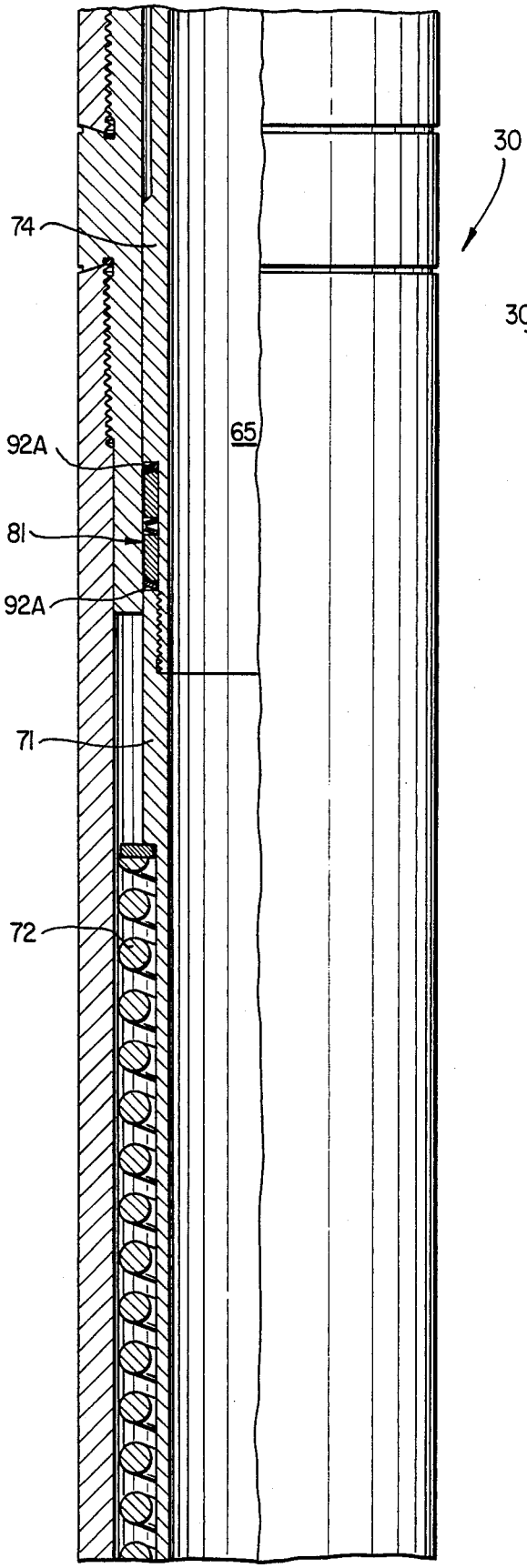
Figure 2C:
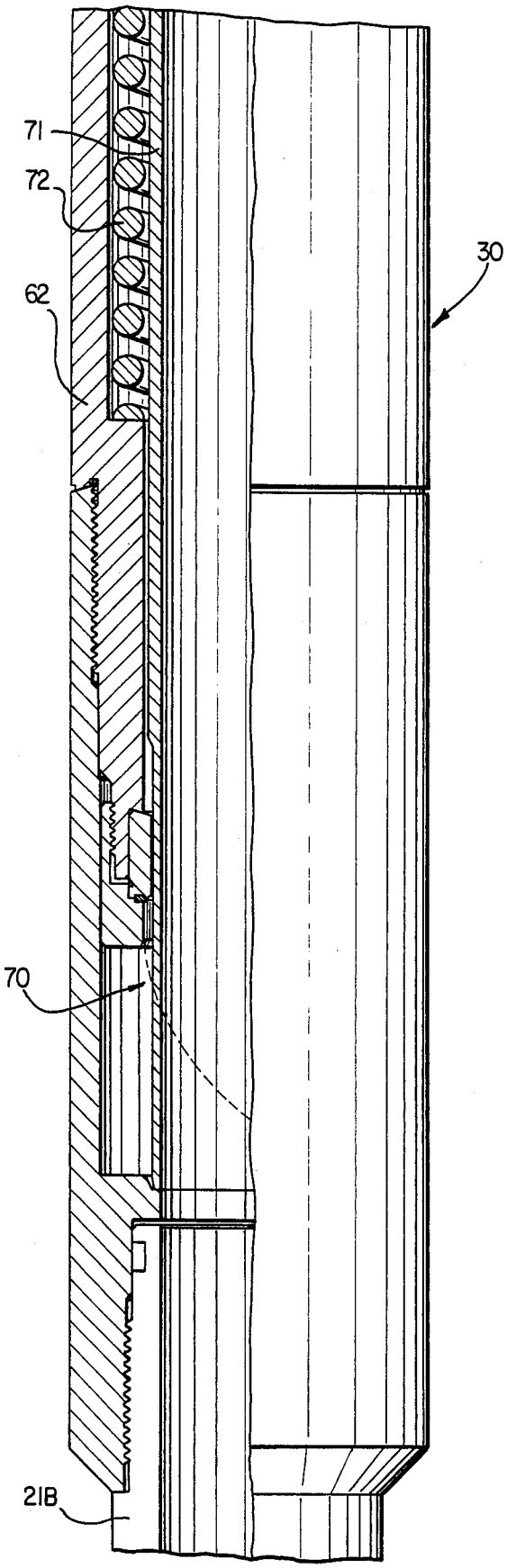

FIGS. 3A, 3B, and 3C together show the safety valve 30 closed. The operator tube 71 is at an upper end position and while the valve assembly 70 is closed as illustrated in FIG. 3C. The upward force of the spring 72 on the operator tube holds the valve closed in the absence of control fluid pressure communicated to the valve through line 26 from the surface. When opening of the safety valve 30 is desired, the control fluid pressure is increased from the surface through the line 26 and the side fitting 29 into the side port 75 through which the control fluid flows into the annular space between the housing and the operator tube along the piston 74 between the top seal assembly 80 and the bottom seal assembly 81. The initial seal of both the seal assemblies 80 and 81 effected by the pre-loaded center Bellville washers 90 retains the control fluid pressure in the annular space between the seal assemblies. As the control fluid pressure increases, the top sealing washer 92 of the upper seal assembly 80 seals between the housing section 64 and the operator tube 71. Similarly, the bottom sealing washer 92A of the lower seal assembly 81 seals between the housing section 61 and the operator tube piston 74. As the control fluid pressure increases the sealing effect of the metal-to-metal seals 80 and 81 increases. When the upward force of the spring 72 is exceeded by the control fluid pressure on the piston 74 over the effective annular area defined by the difference in the sealing lines of the upper seal assembly 80 and the lower seal assembly 81, the operator tube is forced downwardly to the position shown in FIGS. 2A, 2B, 2C, and 3C at which the valve assembly 70 is opened as represented by phantom lines of the valve assembly shown in FIG. 3C. FIGS. 2A, 2B, and 2C show the operator tube 71 at the lower end position. The valve is held opened by control fluid pressure so long as the pressure is kept at a sufficient value to overcome the force of the spring 72. When reclosure of the valve is desired, the control fluid pressure from the surface through the line 26 is reduced allowing the spring 72 to reclose the valve.

FIGS. 2A, 2B, and 2C also show the valve 30 locked open by the sleeve 73 so that well procedures such as wireline operations may be conducted through the valve without accidental closure of the valve. The lockout sleeve 73 is moved to a lower end position as shown in FIG. 2A in which the sleeve is latched to prevent the operator tube 71 from returning upwardly to the valve closed position. The lockout sleeve and the procedures for use of the sleeve are well known and form no part of the present invention.

Figure 5A:
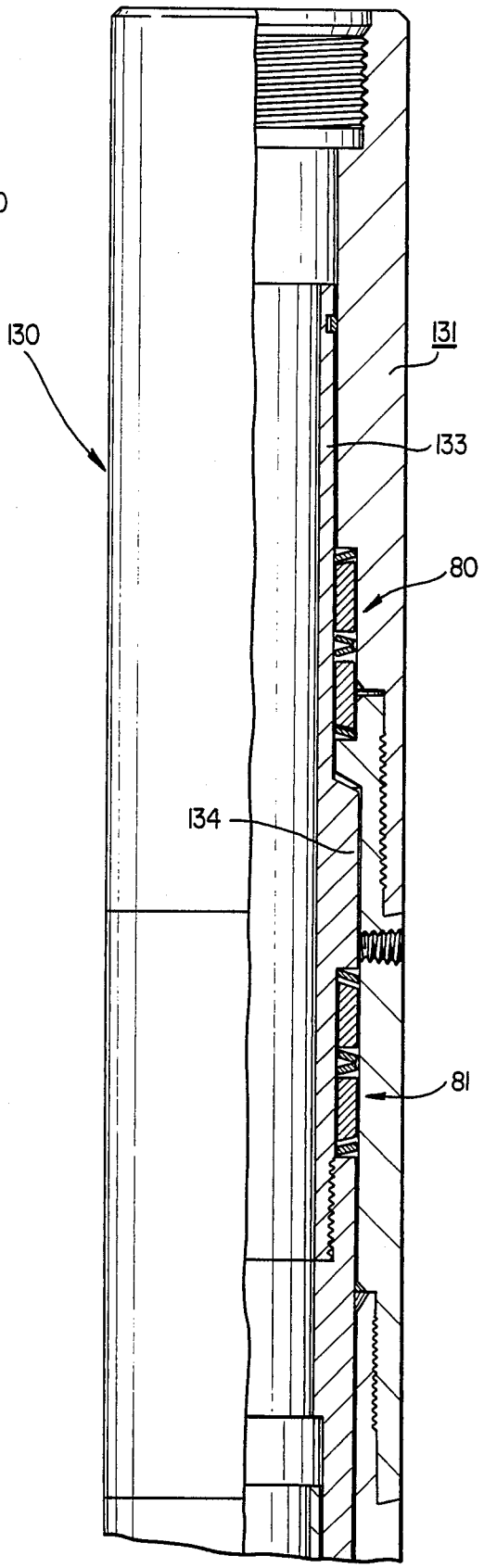
FIGS. 5A, 5B, and 5C form a longitudinal view in section and elevation of the valve of FIG. 4 with the valve closed.
Figure 5B:
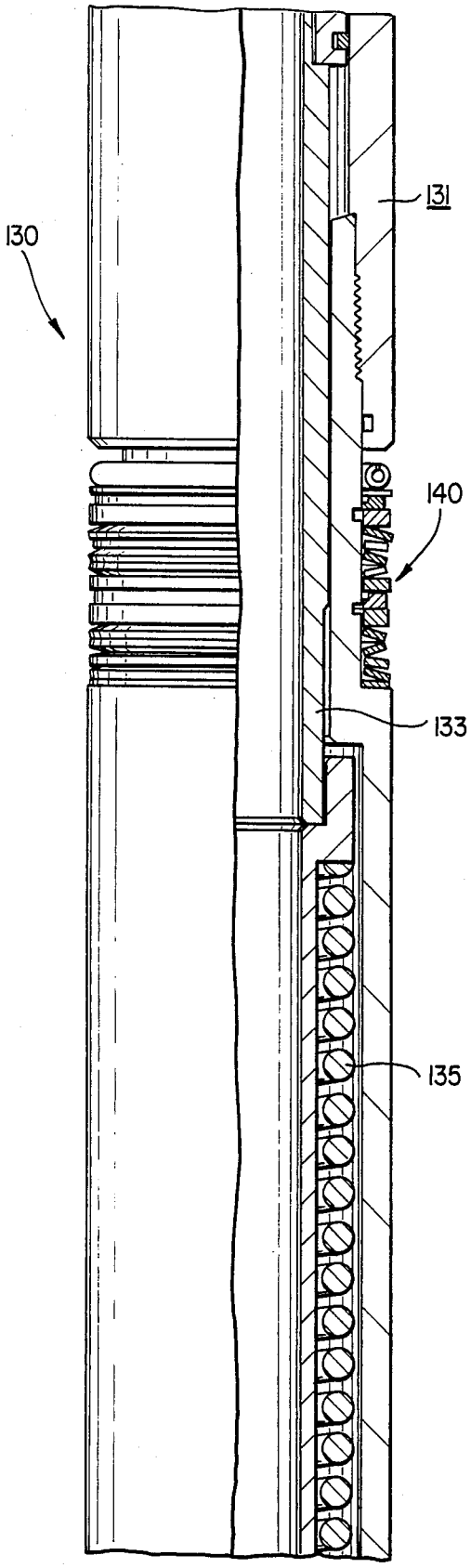
Figure 5C:
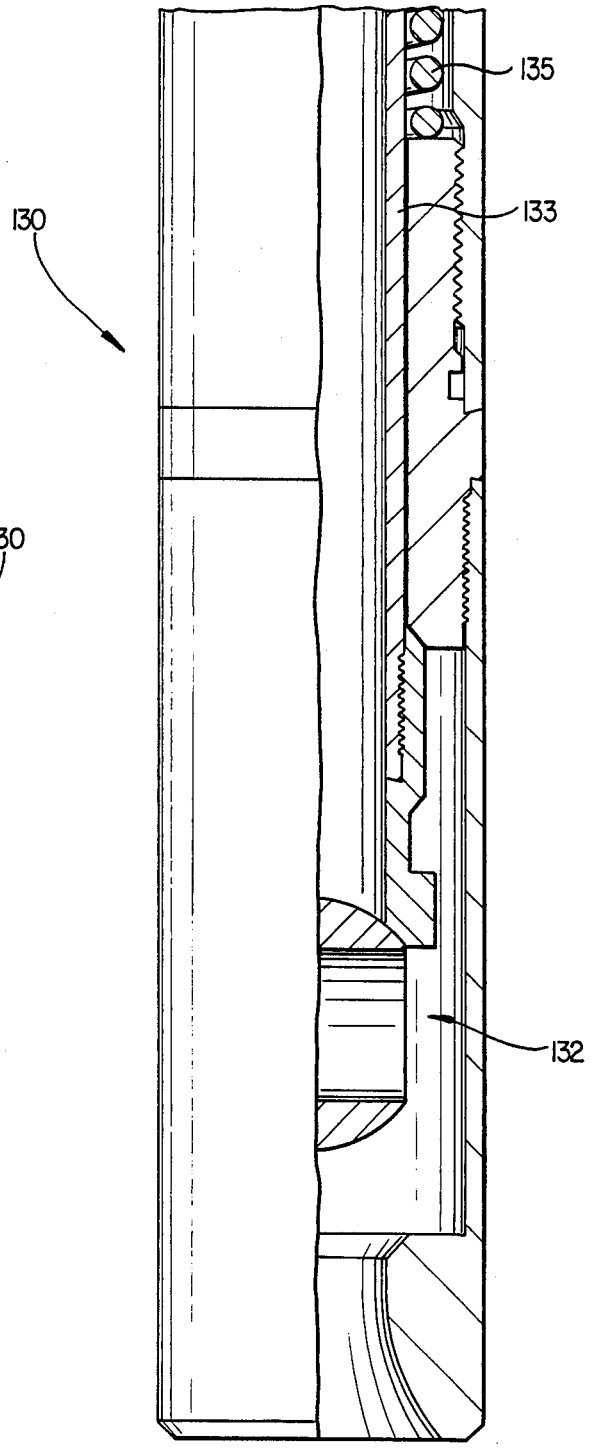

The present invention is equally adapted to a wireline retrievable safety valve 130 as illustrated in FIGS. 4A, 4B, 4C, and 5A, 5B, 5C. Such a wireline retrieveable safety valve may be substituted for the tubing retrieveable safety valve as schematically represented in FIG. 1. A wireline retrieveable safety valve and a safety valve landing nipple are illustrated at pages 146 and 147 of the Otis Engineering General Sales Catalog published in March, 1985. In such an alternate embodiment, a safety valve landing nipple, as illustrated in the reference, is connected in the tubing string 21 and coupled with the control fluid line 26 to the surface. Referring to FIGS. 5A, 5B, and 5C the wireline retrieveable subsurface safety valve 130 embodying the features of the invention includes a housing 131, a ball valve assembly 132 mounted in the housing, and an operator tube 133 mounted in the housing and coupled with the ball valve assembly for opening and closing the ball valve. The operator tubes includes an annular piston section 134 which moves the operator tube downwardly responsive to control fluid pressure. A return spring 135 is mounted between the housing and operator tube for reclosing the valve when the control fluid pressure is released. The annular piston 134 is located between an upper metal-to-metal seal assembly 80 mounted in the housing and a lower metal-to-metal seal assembly 81 mounted on the annular piston. The upper and lower seal assemblies 80 and 81 are identical in structure and function exactly as the previously described upper and lower seal assemblies of the tubing retrieveable subsurface safety valve 30. An external annular seal assembly 140 is mounted on the valve housing for sealing around the housing within the landing nipple when the subsurface safety valve is landed and locked in the nipple for operation to control flow through the tubing string 21. The valve 130 including the seal assemblies 80 and 81, in accordance with the invention, operates in exactly the same manner in the previously described valve assembly 30. The only difference in the valve assembly 130 and the valve assembly 30 is that the latter valve assembly is insertable into and removeable from the tubing string using a wireline, without pulling the tubing string. The valve assembly 30 is installed and must be removed with the tubing string. Otherwise, the structure and function of the valves, as well as, the metal-to-metal seal assemblies 80 and 81 in both valves function in the same manner.

While the metal-to-metal seal assembly arrangement of both the subsurface valves 30 and 130 show the upper seal assembly 80 mounted in the housing and the lower seal assembly 81 mounted on the piston, it will readily recognized that both seal assemblies may be mounted in the housing, or alternatively, the upper seal assembly may be mounted in the outer surface of the operator tube and the lower seal assembly mounted in either the housing or on the piston section of the operator tube.

While it will be recognized that the two-way static and dynamic metal-to-metal seal assemblies embodying the features of the invention are particularly suited to subsurface safety valves of both wireline and tubing retrieveable type, such metal-to-metal seal assemblies also my be used in other applications for sealing a pressurized annular space between concentric members. Such seals are particularly adapted to dynamic sealing and to environments of corrosive fluids and high pressures and temperatures. The simplicity of the design provides for economical manufacture and installation of the seals. Use of softer seal materials than the materials of the parts between which the seal assembly is installed minimize wear on the seal parts.

What is claimed is:

1. In a subsurface well safety valve having a tubular housing, a valve closure member in said housing moveable between open and closed positions for controlling flow through said housing, an operator tube including an annular piston section mounted for longitudinal movement in said housing and coupled with said valve closure member for opening and closing said valve closure member, said operator tube, piston section, and said housing being spaced to define an annular control fluid cylinder in said housing around said operator tube and said piston for moving said piston responsive to control fluid pressure in said cylinder, and two-way static and dynamic seal means for sealing opposite ends of said annular control fluid cylinder in said housing comprising:

a first metal two-way static and dynamic annular seal in said annular cylinder in a recess of said operator tube or said housing sealing one end of said cylinder between said housing and said operator tube including deformable metal frusto-conical shaped washer means between said housing and said operator tube;

a second metal two-way static and dynamic annular seal in said annular cylinder in a recess of said operator tube or said housing spaced from said first metal seal sealing between said housing and said annular piston section including deformable frusto-conical shaped metal washer means between said housing and said operator tube;

each said seal including two washers each washer having a parallelogram shaped cross section and inner and outer annular edges defined by the long diagonal cross section corners functioning as sealing edges, said two washers positioned at opposite ends of each said seal, said washers sloping in opposite directions for sealing in both directions in said annular cylinder; and pre-loading means between said washers for providing an initial stress whereby each said seal effects static seal.

2. A subsurface well safety valve in accordance with claim 1 wherein each said seal is positioned in an annular mounting recess with one sealing edge in an inside end corner of said recess and said sealing washers of each said seal slope toward each other longitudinally from each inside end corner of the mounting recess in which said washers are positioned.

3. A subsurface well safety valve in accordance with claim 2 wherein said sealing washers have chamfered edges at the longitudinally nearest edges of said washers at the outward end of the long diagonal of said washers from the inside surface of said mounting recess.

4. A subsurface well safety valve in accordance with claim 3 wherein each said seal includes central frusto-conical shaped preloading washers in tandem facing in opposite directions to provide an initial load in said opposite directions on said end sealing washers and a spacer ring on each side of said preloading washers between said preloading washers and said end sealing washers.

5. A subsurface well safety valve in accordance with claim 4 wherein said spacer rings each have an end face adjacent said preloading washers lying in a plane substantially perpendicular to the axis of said seal assembly and said spacer rings each have an opposite end face tapered to slope at substantially the same angle of slope of the adjacent end sealing washer at said end face of said space ring.

6. A subsurface well safety valve in accordance with claim 5 wherein each of said preloading washers has a rectangular cross section.

7. A subsurface well safety valve in accordance with claim 6 wherein said preloading and sealing washers are titanium.

8. A subsurface well safety valve in accordance with claim 10 wherein each of said end sealing washers is chamfered at an angle within the range of ten to fifteen degrees relative to the longitudinal axis of each said seal.

9. A subsurface safety valve in accordance with claim 8 wherein said spacer rings are rectangular in cross section.

10. A subsurface well safety valve in accordance with claim 9 wherein safety valve is a tubing retrieveable type valve, said tubular housing being adapted to be secured at opposite ends into a well tubing string to form an integral part of said tubing string.

11. A subsurface well safety valve in accordance with claim 9 wherein said safety valve is a wireline retrieveable type valve, said tubular housing including an external annular seal assembly for sealing with an annular seal surface in a landing nipple secured in and forming a part of a well tubing string.

* * * * *